US005573248A

United States Patent [19]

Parra et al.

[11] Patent Number: 5,573,248

[45] Date of Patent: Nov. 12, 1996

[54] CASINO DICE GAME APPARATUS USING THREE DICE AND PLAYED ON A SEMICIRCULAR GAMING TABLE

[76] Inventors: Anthony C. Parra; Debra Parra, both of 1101 Iroquois Ave., Apt. 1204, Naperville, Ill. 60563

[21] Appl. No.: 441,046

[22] Filed: May 15, 1995

[51] Int. Cl.[6] ..... A63F 3/00; A63F 9/04

[52] U.S. Cl. ..... 273/274; 273/309; 273/145 C

[58] Field of Search ..... 273/274, 309, 273/146, 145 C

[56] References Cited

U.S. PATENT DOCUMENTS

| | | | |
|---|---|---|---|
| 4,688,803 | 8/1987 | Ollington | 273/146 |
| 5,350,175 | 9/1994 | DiLullo et al. | 273/146 |

FOREIGN PATENT DOCUMENTS

| | | | |
|---|---|---|---|
| 2066086 | 7/1981 | United Kingdom | 273/274 |

*Primary Examiner*—Benjamin H. Layno
*Attorney, Agent, or Firm*—Welsh & Katz, Ltd.

[57] ABSTRACT

A dice game apparatus includes a gaming table having a generally horizonal plane surface forming a generally arcuate peripheral edge about which a plurality of players are located. A game board is displayed on an upper surface of the table with a board having designated thereon a first series of individual crap bet placing areas positioned in a repetitive pattern along a portion of the table extending along the arcuate peripheral edge. The dice game is played with a set of two casino dice having six faces and an additional third die enclosed in a shake container. The shake container is configured and adapted so that each of the dice randomly registers one of the faces after a shaking of the container. The shake dice game method includes a portion whereby the players make wagers in general accordance with the rules of craps on the faces registered by the casino dice after a shaking of the container. To provide an additional reward, an additional bet may be placed on an occurrence where both the first set and the third die register faces having the same number. Players then receive rewards in an amount determined by the bets they placed on the outcome of the combination of sides on the casino dice and should the first set of dice and third die all register a face having a same number, the players who bet on such an occurrence are paid an additional reward.

4 Claims, 6 Drawing Sheets

140

SHAKE- DICE
MINIMUM BET
MAXIMUM BET
ANY CRAPS PAYS 8 FOR 1
ELEVEN PAYS 15 FOR 1
HARDWAY'S WORK ON THE COME OUT.
BETS MUST BE TAKEN DOWN, NO "ON" OR "OFF".
NO CALL BETS.
PLAYERS MUST WAIT UNTIL ALL BETS ARE PAID OR TAKEN
BEFORE PLACING HANDS ON THE LAYOUT.

CASINO DICE GAME APPARATUS USING THREE DICE AND PLAYED ON A SEMICIRCULAR GAMING TABLE

FIELD OF THE INVENTION

The present invention is generally directed to a method and apparatus for playing a casino game of chance. In particular the present invention relates to a dice game and table layout for the dice game. The present invention also relates to a table for the playing of casino games such as the crap game with the table particularly useful when the space for the table is limited and also to reduce a number of personnel necessary for operating the casino game.

BACKGROUND OF THE INVENTION

Craps is one of the more popular gambling games. As is well known, the game is played on an elongated table having a game board displayed along the upper surface of the table. The game board displays certain wagering areas, and the elongated table allows the dice roller to roll two dice along the table so that the dice register on the upper faces, one of the six possible faces. The reward will then be paid out as determined by the rules of craps. However, the use of the elongated table has several drawbacks. For example, the typical craps table is elongated primarily to ensure that when the dice are tossed down the table, the dice are forced to roll; therefore, the typical craps table takes up a lot of space on a gambling floor. In gambling locations where space is limited, such as river boats, the amount of space becomes invaluable.

Also, because the table is elongated, the table is formed with typically two betting areas on either end and a central betting area. Four crap table operators, three dealers and a boxman, one of the dealers at each end and one in the center who is responsible for sending out and retrieving the dice after the dice are rolled, are needed to monitor the bets so that the bets are placed on the proper locations in the betting areas. The necessity of using four people to monitor the typical crap table lowers the profitability of these crap tables.

In addition, it is advantageous to provide the typical crap game with an additional pay out. The chance of an additional reward in addition to the typical crap pay out rewards, may entice gamblers to make wagers and also to wager for longer periods of time.

Moreover, it is desirable that the table may be easily adaptable to the playing of different casino games. The casino operator may then alter the mix of tables set up for the various games without the need to replace the tables.

Furthermore, the more time a player spends at a table playing a casino game, the more profitable the table typically is. Among the reasons a player may leave a table is to communicate with an entity outside of the general playing area. For example, the player may need to make dinner accommodations, take a message and place a bet or check on the results of outside events such as sport games.

Therefore, it is an object of the present invention to provide an improved crap table which reduces the space necessary to play a crap game.

It is also a further object of the present invention to provide an improved table layout which enables a crap game to be played by multiple participants while reducing the number of persons necessary to operate the crap game.

It is yet another object of the present invention to provide an improved method of playing craps wherein an additional reward is available depending in at least in part on the outcome of the crap game.

It is a still further object of the present invention to provide an improved table which accommodates a player's desire to communicate to an entity outside of the general playing area without requiring the player to leave the table.

It is an additional object of the present invention to provide an improved table for the playing of casino games which may be easily adapted to the playing of various other games.

SUMMARY OF THE INVENTION

The above objects are met and exceeded by a dice game and apparatus of the present invention. The dice game apparatus includes a gambling table having a generally horizontal replaceable, playing surface forming a generally arcuate peripheral edge about which a plurality of players are located. A game board is displayed on an upper surface of the table with the board having designated thereon a first series of individual crap bet placing areas positioned in a repetitive pattern along a portion of the table extending along the arcuate peripheral edge. The dice game is played with a set of at least two dice having six faces and a shake container with the dice being enclosed in a compartment formed by the shake container. The shake container is configured and adapted so that each of the dice randomly registers one of the faces after a shaking of the container.

The shake container may also be configured to form at least one additional compartment containing an additional die. The third die is formed with six faces with each of the faces having a representation corresponding to a number on one of the faces of the set of two dice. To provide an additional reward, the dice game may be played by first placing crap bets on the occurrence on the combination of sides of the first set of dice and the placing of an additional bet on an occurrence whereby the first set of dice each register a same number which corresponds to a seat number assigned to the player's position at the table and the third die also registers the representation corresponding to the same number. The dice shake container is then shaken so that the first set of dice and third die randomly register at least one of the sides of all of the dice. Players then receive rewards in an amount determined by the bets which were placed on the outcome of the combination of sides on the first set of dice and should the first set of dice and third die all register a face having a same number or representation thereof, the player which occupies that seat position and who bet on such an occurrence is paid an additional reward.

Preferably, the game is played with the first set of dice being a regular pair of crap dice and the third die being of the same configuration as the first set of dice. In addition, the table may include slot areas proximate the crap bet placing areas to allow the individual player to make the wager on the outcome of the first set and third die. The wagering slot may be operatively attached to a counter which registers the wagering of a bet in that slot providing an output to a central control system. The control system in turn then calculates the reward for players who are placing bets on the outcome of the first set and third die with that reward being determined at least in part of the amount of money being wagered on the outcome of the first set and third die.

Alternately, the table may be formed with communication centers dispose between at least two of the player positions.

The communication centers allowing the player to receive and transmit information to remote locations without the player leaving the playing position. The table may also be configured to visually accent predetermined positions on the table, and allow for easy replacement of the top playing surface so that the table may facilitate the playing of other casino games.

DESCRIPTION OF THE PREFERRED EMBODIMENTS

Figure 1:
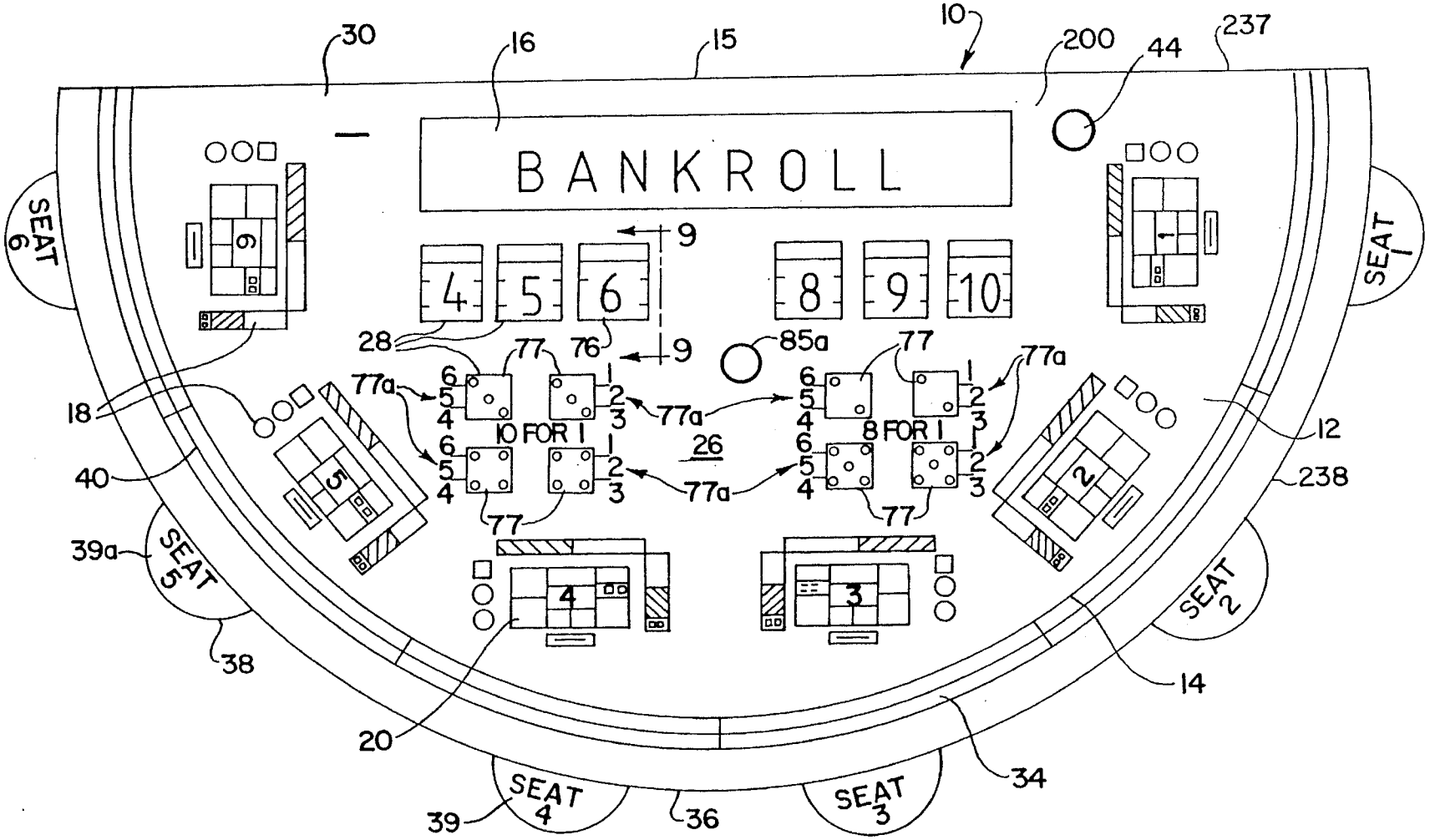
FIG. 1 is a top plan view of a game layout board for playing a dice game of the present invention.
Figure 2:
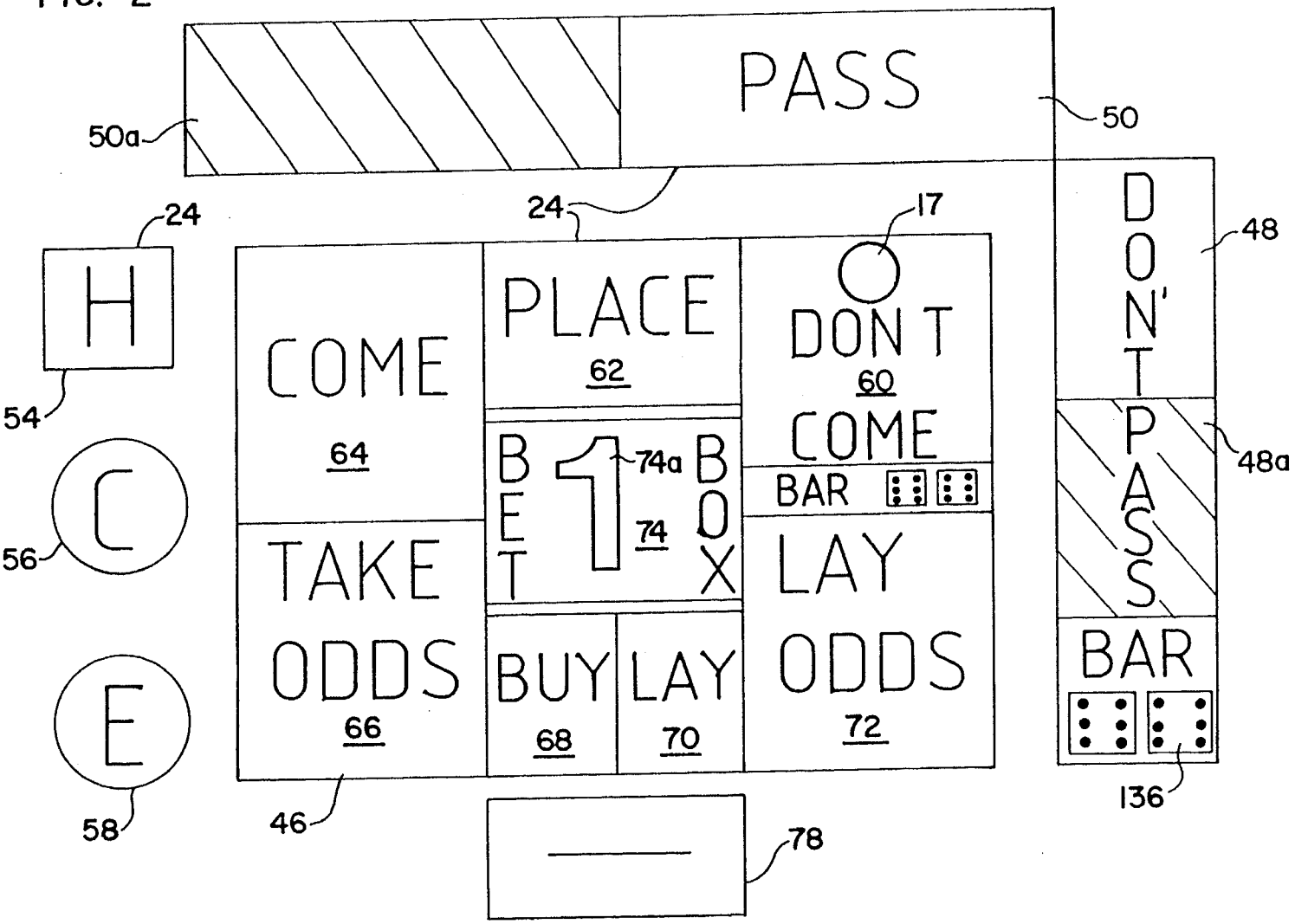
FIG. 2 is a enlarged plan view of the wagering areas forming repetitive portions on the game board of FIG. 2.

Referring to FIGS. 1 and 2, a playing surface for a "shake dice" game according to the present invention is generally designated at 10. The playing surface 10 is divided into a plurality of areas for placing and registering bets on the outcome of the shake dice game. Depending on the outcome of the shake dice game, the players are paid rewards or lose the placed bet.

Referring in particular to FIG. 1, the playing surface 10 has a peripheral first or betting zone 12 bordered by an outer peripheral edge 14 which is preferably arcuate shaped and about which a plurality of players are located. Preferably, the outer edge 14 is semicircular shaped to be equidistant from a bankroll portion 16 of the surface 10 which lies midway along an inner edge 15. A "dealer" is typically placed adjacent the bankroll portion 16 to administer the shake dice game and betting. A bankroll (not shown) is placed on the bankroll portion and contains betting chips 17 (FIG. 7) for representing betting amounts for the shake dice game.

Along the betting zone 12 is a series 18 of wagering areas or betting boxes 20. The betting boxes 20 define betting areas 24 on which individual players may place or indicate bets or wagers on the various outcomes of the game. The betting boxes 20 are similarly configured and positioned to form a repetitive pattern within at least a portion of the betting zone 12. Also, the betting boxes 20 may be configured so that a number of the boxes, such as the boxes disposed along one end of the betting zone 12, are mirror images of the remaining boxes, such as shown in FIG. 1.

Depending on the type of bet placed within the bet box 20 by the player, the bet may be moved by a dealer to a second or outcome zone generally indicated at 26. Within the outcome zone 26 are numerical representation areas 28 of various outcomes of the shake dice game.

Preferably, the playing surface 10 is formed on transparent acrylic and forms the horizontal top 30 of a table 34 with an outer edge 36 of the top configured to mimic the configuration of the peripheral edge 14 of the playing surface 10. Chairs 38 may be placed about the edge 36 for the players of the game. Each of the chairs 38 is preferably labeled with an indication 39 such as a number **39*a* which identifies the players position. The numbers 39*a* range from 1–6 are assigned in ascending order around the table 34. Chip retention slots 40 may be fashioned in the outer edge 36 at the player positions to hold a player's chips 17 (FIG. 7**) during the course of the game.

Generally the shake dice game includes a craps portion which includes many of the steps and rules for playing craps. Thus the betting areas 24 within each of the boxes 20 are individually marked so that by placing a bet on a particular betting area, and in certain instances accompanying the placement with verbal instructions, a player may represent to the dealer the desired bet on the shake dice game. Depending on the type of bet and before a shake of the dice, the dealer may then move the bet to a particular location in the areas within the outcome zone 26. Thus the betting or actions of the player is confined within the bet box 20 which facilitates the monitoring of the game by the dealer so that an individual dealer may run and monitor the game. Also the dealer may easily reach chips 17 placed within the individual bet boxes 20 because of the semicircular configuration of the playing surface 10.

The surface 10 also includes a point marker area and dice cup rest 44 upon which a point marker 130 (FIG. 5) and a dice cup (not shown) to hold dice not in use in the game can be placed at times during the course of the game.

Referring to FIG. 2, the betting areas 24 of the bet box 20 form indications of the wagers of the individual players on the various potential outcome of the shake dice game, a preferred method of which is described below. In particular, the bet box 20 includes a central area 46, preferably rectangular, bordered on one side by a "don't pass" area 48 and along an adjacent side by a "pass line" area 50. The pass line area 50 and the don't pass area 48 may include "odds" indicating areas **50*a*, 48*a*, respectively, which are preferably cross hatched for identification. On a side of the central area 46 opposite the don't pass 48 are individually designated "hardways" 54, "craps" 56 and "eleven" or "yo" 58 areas. For brevity, the hardways area 54, craps area 56 and eleven area 58 may be designated with an H, C and E, respectively. Within the central area 46 area, a "don't come" area 60, "place" area 62, "come" area 64, "take odds" area 66, "buy" area 68, "lay" area 70 and "lay odds" area 72 are displayed. The central area 46 may also include an identifying area 74 having a number 74*a* indicating the particular bet box 20. The number 74*a* corresponds to the position of the player and is equal to the number 39*a*** on the chair.

Referring back to FIG. 1, within the outcome zone 26, the representation areas 28 represent a subset of the possible outcomes from a shake of the dice. In the preferred embodiment, the representation areas 28 include areas 76 representing the 4, 5, 6, 8, 9, and 10 outcomes from a shake of the dice. Also, within the outcome zone 26 are graphical representations 77 of particular combinations of faces of the dice representing various "hardways" combinations. The hardways combination being typically defined by an occurrence whereby the dice forming the craps portion of the shake dice game register the same face.

Figure 8:
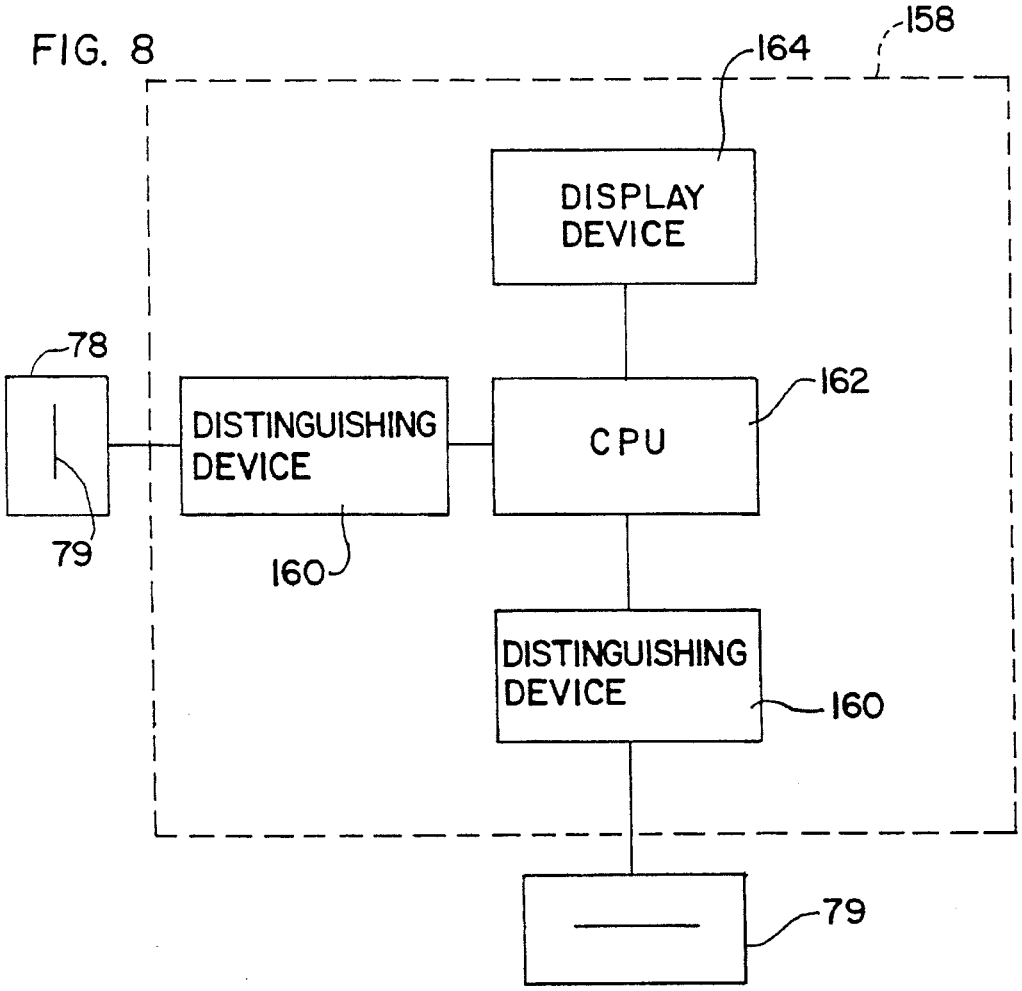
FIG. 8 is a diagrammatical view of a control system for determining and displaying the reward amounts for a progressive jackpot forming one of the rewards for the dice game of the present invention.

In accordance with a feature of the shake dice game, in close proximity to each of the bet boxes 20, the playing surface 10 also includes a progressive jackpot area 78, for placing a bet on a "real hardway", a preferred example of which is defined below. Preferably, the jackpot area 78 includes a slot 79 for feeding a coin or chip into a tabulating system 158 (FIG. 8).

Figure 3:
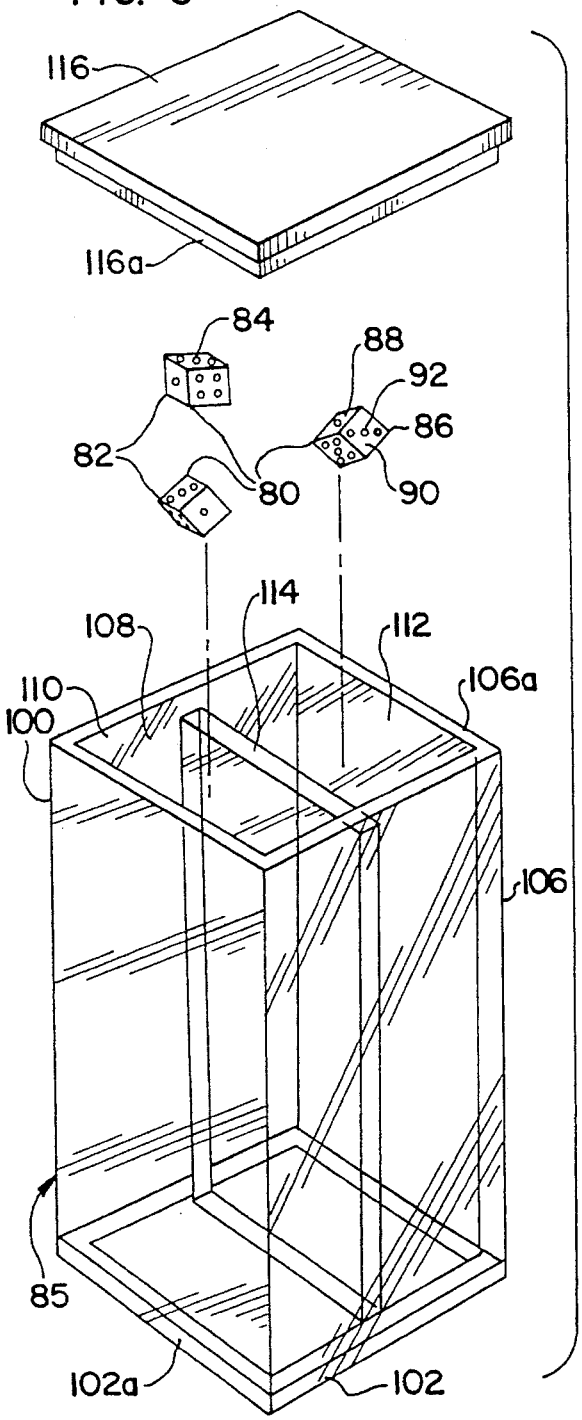
FIG. 3 is an exploded elevational view of a preferred embodiment of a shake dice container for use in playing the dice game of the present invention.

Referring to FIG. 3, the dice 80 for playing the shake dice game of the present invention are illustrated. The dice 80 include a first set of dice 82 which preferably are the typical dice found in casinos. The first set 82 has six faces 84 which each of the faces having pips ranging in number from 1 to 6. During playing of the game and as described below, the first set 82 are shaken within a container generally indicated at 85. After the shaking, the dice 80 come to a rest within the container 85. Then the number of dots on the top faces of the two dice are summed together to define a number which is "registered" and on which wagers are won or lost for a craps portion of the shake dice game.

In addition, the dice 80 include a third die 86. The third die 86 has six faces 88 and is preferably similar to the dice of the first set 82 in that each of the faces 88 has a representation corresponding to one of the faces of each of the die of the first set of dice 82. Preferably, each of the faces 88 has a representation formed similar to one of the faces of the dice of the first set 82 by having a number of pips 92 on the representation face surface 90. Alternately the face 88 may have representation of distinct items such as various animals with each animal corresponding to a number of pips on the faces of the first set 82 of dice.

Figure 4:
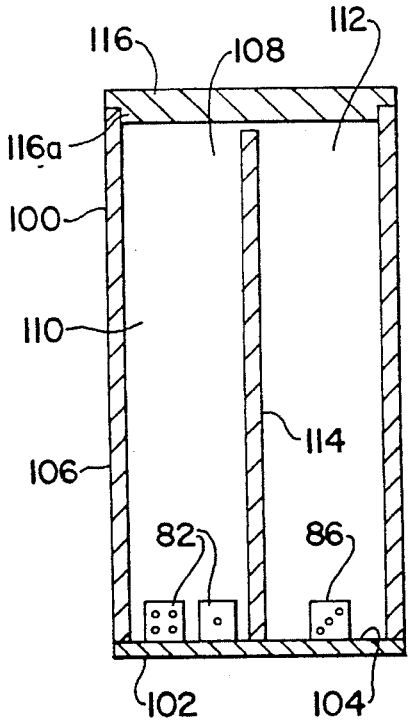
FIG. 4 is a side sectional view of the shake container of FIG. 3.

Referring also to FIG. 4, the first set of dice 82 and the third die 86 are selectively placed in the enclosed container 85. The container 85 is configured so that the shaking of the container causes a random tumbling of the dice 82, 86.

The container 85 contains a base 102 having an upper surface 104 which is generally flat. One of the faces of the die rests on the upper surface 104 and the opposite face or top face displays the number which is registered on a shake of the dice. The base 102 has a periphery 102*a* which may be polygonal or arcuate; however, in the preferred embodiment, the base 102 has a square periphery.

Side panels 106 are attached about the base 102 and extend upward to form a chamber 108 which is separated into a first compartment 110 and a second compartment 112 by an internal divider wall 114. The first and second dice 80 making up the first set of dice 82 is contained within the first compartment 110 while the third die 86 is contained within the second compartment 112. At least one of the side panels 106 is transparent to permit observation into the chamber 108 including both the first compartment 110 and second compartment 112. Preferably all of the side panels 106 are transparent.

The container 85 also includes a lid 116 which may be attached to the side panels 106 in a manner which allows access to the first compartment 110 and second compartment 112. In the preferred embodiment, the lid 116 may be removed from the side panels 106 to allow substitution of the dice 80 and then replaced upon the top of the side panels to cover and enclose the chamber 108. The lid 116 has a lower portion 116*a* which is formed to register within the upper ends 106*a* of the side panels.

The container 85 should be sized so that the first compartment 110 and second compartment 112 are sufficiently enlarged to permit free, random tumbling motion of the dice 80 within the compartments. Preferably the container 85 is made of a hard material so that when dice 80 are in the first and second compartments 110, 112, the container may be shaken and the impact of the dice against the base 102, side panels 106 and lid 116 causes the random tumbling of the dice. After the shaking of the container 85 ceases, the dice 80 rest on the upper surface 104 and the sum of pips on the top face of the first set of dice 82 register a number for the craps portion of the shake dice game. The third die 86 rests on the upper surface 104 and the number of pips 92 on the top face registers a number for the progressive jackpot portion of the shake dice game. This shaking of the dice 80 in the container 85 and subsequent registering of the number on the first set of dice 82 and the registering of number on the top face of the third die 86 is a "shake" of the dice.

The container 85 may be fabricated from sheets of plexiglass which are cut to the appropriate geometric configuration and attached to each other, by adhesive or other methods.

Figure 5:
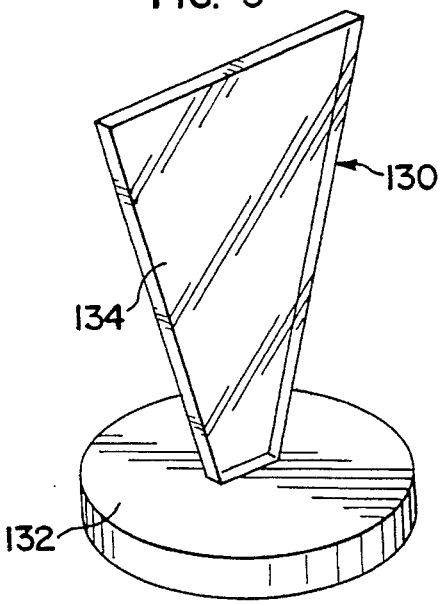
FIG. 5 is a perspective view of a point marker used in playing the dice game of the present invention.

Referring to FIG. 5, the point marker of the present invention is generally designated at 130. The point marker 130 is used to indicate the pass point and includes a base 132 which is preferably disk shaped. A handle 134 is connected to the base so that the point marker 130 may be easily moved about the playing surface. For aesthetic purposes, the handle 134 may be triangually shaped.

Referring to FIG. 4, generally the preferred embodiment of the shake dice game of the present invention includes as a portion a method of playing which is similar to a casino craps game. In the craps game portion, players make wagers on the outcome of a shake of the first set of dice 82. In addition to the craps portion, a player may also wager on the registration of the faces of both the first set of dice 82 and the third die 86 together.

The game of craps or casino craps is well known. The rules for the casino portions of the shake dice game are very similar to casino craps game; however, it is preferred that the casino portion of the shake dice game be suitably adapted for playing on the playing surface 10 (FIG. 1).

Figures 6, 7:
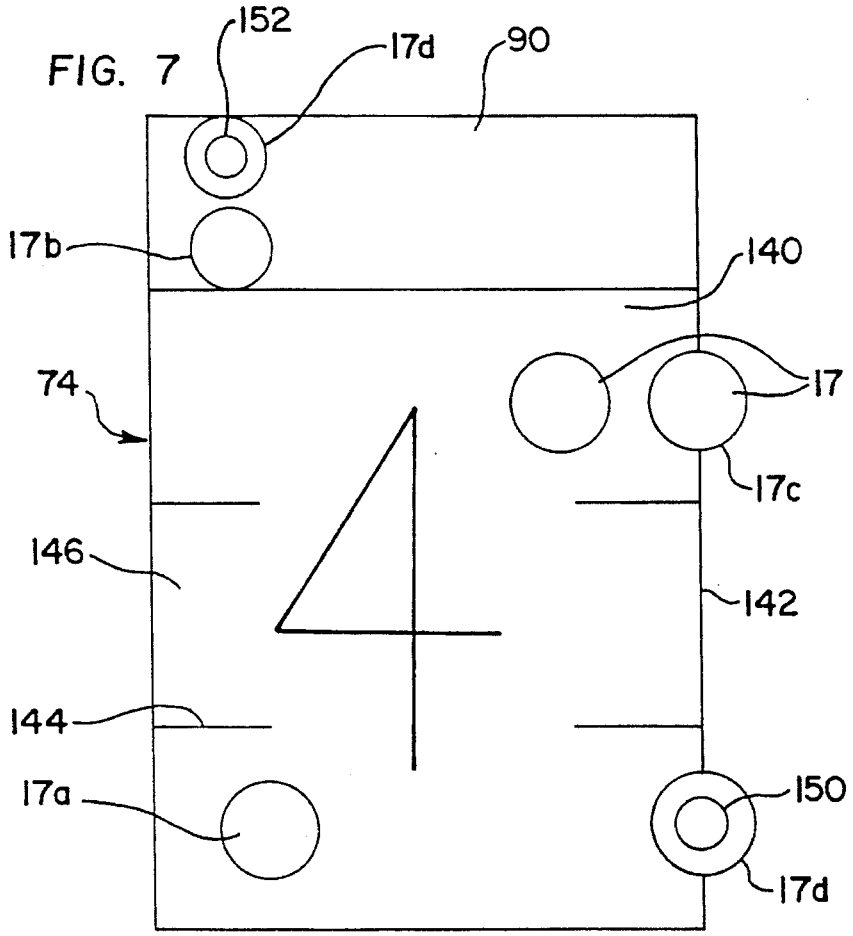
FIG. 6 is a representation of an information sign for setting forth a portion of the preferred rules for the dice game of the present invention.
FIG. 7 is an enlarged plan view of a numerical representational area forming a portion of the playing surface of FIG. 2.

Referring to FIG. 6, a sign 140 is typically prominently posted to alert players as to those aspects of the shake dice game which differ from the standard method of playing craps.

Referring to FIGS. 1, 2 and 3, the shake dice game may begin by the dealer asking the players to place their bets. The bets are then placed by the players on one of the betting areas 24 of the betting boxes 20. In dependence on the type of bet, the dealer may then move the bet to a particular location in the outcome zone 26. After the bets have been placed and possibly moved by the dealer, the dealer takes the container 85 from the shake box area 85*a* with the first set of dice 82 in the first compartment 110 and third die 86 in the second compartment 112. The dealer then shakes the container 85 to cause the random tumbling of the dice 80 and then places the container back on the shake box area 85*a*. Upon placing the container 85 on the shake box area 85*a*, the dice 80 may come to a rest and the top faces of the first set 82 and third die 86 register the outcome of the shake.

Because the dealer is the only person who comes in contact with the container 85 and dice 80, the chance of substitution of the dice with other dice by the players is eliminated. Also, because the random tumbling of the dice 80 is generated by the shaking of the container 85, the size of the playing surface 10 does not need to be large enough to allow the rolling of the dice such that the playing surface 10 and table 34 (FIG. 1) will generally be much smaller than the typical craps table. This reduction in size increases the efficiency of space usage for casinos.

In particular, before a shake of the container 85 and dice 80 each of the players may place a bet on the pass line area 50 of the bet box 20. The dealer shakes the dice container 85. The first shake, and all subsequent shakes when there is no "pass point", is called the "come-out shake". If, on the come-out shake, a 7 or an 11 is registered by the first set of dice 80, all pass line bets win immediately. If any crap number 2, 3 or 12 are registered, all pass line bets lose immediately. If a 4, 5, 6, 8, 9 or 10 is registered on the first set of dice, that number will now be called the pass "point". To indicate the "point" the dealer moves the point marker 130 (FIG. 5) from the point marker area 44 to the appropriate number representation 76. The dealer continues to shake the dice 80 and place the container 85 on the shake box area 85*a* to register additional outcomes until the "point" or a 7 shakes. On subsequent shakes of the container 85, if the dealer shakes the "point" a second time, before a 7, then all pass line bets win because the pass point was made. But, if the dealer shakes a 7 before the "point" or "sevens-out", all pass line bets lose.

In contrast, the players may bet "against the dice", by placing a bet on the don't pass area 48. Betting against the dice is betting that after having established a "point", the dealer will fail to shake the pass point again before a seven is registered. On the come-out shake and a shake which registers a 7 or 11 on the first set of dice, a don't pass bet loses and on a come-out shake of a 2 or 3 a don't pass bet wins, but a come out shake of a 12 is a "stand-off" with no winner or loser. The stand-off result of a shake of 12 is indicated by a representation 136 on the don't pass area of a pair of dice registering a 12. After the pass point has been established, the player loses a bet placed in the don't pass area 48 if the "point" is shaken before a seven, and the player wins if the dealer shakes a 7 before the "point" is shaken or "sevens-out".

The player may also place a bet in the come area 64 of the bet box 20 at any time after the come-out shake. If a 7 or 11 is registered on the first set of dice 80 in a shake immediately following placement of the bets in the come area 64, a come bet wins and if any craps, i.e., 2, 3 or 12, are registered, a come bet loses. If any other number is registered by the first set of dice 80, that number becomes the come point and the dealer moves all come bets up from each bet box 20 to one of the designation areas 76 which corresponds to the come point. The dealer then places a bet from a particular bet box 20 on a particular location, which identifies the bet with the particular bet box, in or adjacent the appropriate number representation 76. Referring to FIG. 7, in conjunction with FIGS. 1 and 2, for example, chips 17*a* representing the come bet are placed along a peripheral portion 140 running adjacent a peripheral border line 142 of the number designation area 76. The designation area 76 may also have indicator lines 144 which clearly separate the peripheral portion 140 into locations 146 which identify the bet box 20 from which the bet was moved. For example, the placement of chip 17*a* may identify the bet as coming from bet box number 4.

On subsequent shakes if the come point is again registered by the first set of dice 82 before a 7 is registered, all come bets win. If a 7 is registered first, all come bets in the number designation areas 76 lose. A come bet cannot be reduced or removed after a come point has been established.

Each of the players may place a bet in the don't come area 60 of the bet box 20 at any time after the come-out shake. Generally the don't come bet plays the craps portion of the shake dice game in reverse of the come bet. The don't come bets lose on a registration on the first set of dice of a 7 or 11 and win on a registration of a 2 and 3 on the shake immediately following placement of the bet in the don't come area 60. When a 12 is registered a player neither wins nor loses. When a 4, 5, 6, 8, 9 or 10 is registered, a don't come point is established. When a don't come point has been established the bet in the don't come area 60 is moved by the dealer and placed in a block area 90 adjacent and behind each of the number designation areas 76. In a manner similar to the placement of the come bets, the dealer places the chips 17*b* representing the don't come bet from a particular bet box 20 in a specific location within the block area 90 to identify from which bet box 20 the bet was moved. Don't come bets cannot be increased after a point has been established but may be removed or decreased.

If a player has a bet on the pass line area 50, the player may "take the odds" once the "point" has been established. This is done by placing a second bet in the cross hatched area 50*a* within the pass line area 50. Pass line odds may be removed at any time. If the player wins on the pass point bet, the player is paid even money for his first (original bet) or "flat bet" on the pass line, and that player is paid an additional reward such as "true odds" for the second or "odds" bet beside the "flat" bet. The additional reward is set by the house. For example, true odds may be:

for a pass point of 4 and 10—2 to 1,
for a pass point of 5 and 9—3 to 2,
for a pass point of 6 and 8—6 to 5.

A player may also "take odds" on a come bet. The additional reward is typically the same as the odds for the pass line bets. The player indicates a take odds bet by placing the bet on the take odds area 66 and also directing the dealer as to which of the come bets established by a previous come bet the player is taking odds on. The take odds bet is moved by the dealer and placed on top of the players come bet inside the numbers representation 76. The dealer will typically "offset" the take odds bet so the dealer can tell which bet was the original bet and which is a take odds bet.

If a player has a bet on the don't pass area 48, the player may "lay the odds" once the pass point has been established. This is done by placing a second bet directly behind the original don't pass line bet in the don't pass area 48. This is done by placing a second bet in odds area 48*a*. If the first set of dice 82 registers a seven before the pass "point", the player is paid even money for his first don't pass bet, and that player is paid an additional reward such as true odds for the second bet. The additional reward is generally set as the reverse of the pass line odds. For example, in true odds the odds may be:

for a don't pass point of 4 and 10—1 to 2,
for a don't pass point of 5 and 9—2 to 3,
for a don't pass point of 6 and 8—5 to 6.

The amount of odds bet allowed are determined by both the pass "point" and the size of the bet of the player.

A player may also "lay odds" on a don't come bet. The player places the bet in the lay odds area 72 and directs the dealer as to which don't come bet the odds are being laid against. The dealer removes the bet from the laying odds area 72 and places the bet adjacent that players don't come bet in the block area 90. The additional reward is typically the same as it is for laying odds on the don't pass. Don't come odds will always be "on" or working, on the come out shake, conversely, take odds are always "off", that is not "working" on the come out shake.

A player may wish to bet on a shake of a particular number or all the numbers individually without going through the come betting procedure. This can be done by "place betting" the numbers. If a shake causes a 7 to register on the first set of dice 82 before the selected number or numbers is registered by the first set of dice, all place bets lose. The player makes a place bet by placing a bet on the place area 62 of the bet box 20 and directing the dealer as to which number and how much the player is place betting. The dealer moves the bet to a particular location on the corresponding number representation 76 to identify from which bet box the bet was moved. In particular, the dealer places the chips 17*c* representing the bet on the particular spot on the border line 142 which geographically corresponds to the appropriate bet box. Place bets are "off" on the come out shake and typically pay out according to the following odds.

On a place bet 4 and 10 to win—9 to 5
On a place bet 5 and 9 to win—7 to 5
On a place bet 6 and 8 to win—7 to6

It is frequently to the advantage of the players to "buy" a number such as the 4 or 10 as opposed to place betting these numbers. A buy bet is simply a bet similar to a place bet that the player pays an additional commission, generally 5%, to the house in order to receive an additional reward such as true odds on that bet. The player makes a buy bet by placing a bet on the buy area 68 and directs the dealer as to which number the player is buying. The dealer moves the chips 17*d* representing the bet to the appropriate number representation 76 and places the bet on the borderline of the representation at a geographical location which identifies the particular bet box 20 from which the chip was moved. The buy bet is distinguished by a buy button 150 placed on the chips 17*d*. Also, these buy bets play as do place bets, they are off on the come out shake and typically pay out according to the following odds.

On a buy bet on 4 and 10—2 to 1
On a buy bet on 5 and 9—3 to 2
On a buy bet on 6 and 8—6 to 5

In the same way that a player can buy a number to receive an additional reward, it is also possible for a player to buy behind a number and bet that 7 will be registered by the first set of dice 82 before the buy number is registered. In this situation, the player will wager an amount and receive don't pass odds noted as follows:

for a don't pass point of 4 and 10—1 to 2,
for a don't pass point of 5 and 9—2 to 3,
for a don't pass point of 6 and 8—5 to 6.

The player will typically be charged a 5% commission on the actual payoff.

Prior to a shake, the player places the bet in the lay area 70 and directs the dealer as to which number the lay bet is for. The dealer moves the chips 17*d* representing the bet to the block area 90 and places the bet on the particular location to correspond the bet with the bet box 20 and player. A lay button 152 is then placed on the chips 17*d* to distinguish the bet from a don't come bet which may also be in the block 90. Lay bets work on any of the shakes. If a player wants to, lay bets may be reduced or removed prior to a shake.

Thus, it is apparent that bets placed in the central area 46 are moved, either before or immediately after a shake, to the outcome zone 26. Thus, the central area 46 assists the dealer in distinguishing these bets from bets which are not moved, such as pass line and don't pass bets. Also, placing the pass line area 50 on the side of the central area 46 away from the player hinders dishonesty as the player must visibly reach over the central area to place such a bet. Such movement should be readily apparent to the dealer.

A player may place a bet in the craps area 56. A bet made in the craps area is called "any craps" and can be made any time before the shake of the dice. The bet remains in the craps area 56 during the shake of the container 85. If 2, 3, or 12 is registered by the first set of dice 82, the bet wins. If any other number is registered, the bet loses. This is a one shake bet and pays out odds such as 8 for 1.

A player may place a bet in the eleven area 58. A bet made in the eleven area 58 is called "Eleven" or "Yo", and can be made any time before the shake of the dice. The bet remains in the elevens area 58 during the shake. If "eleven" is registered by the first set of dice 82, the bet wins. If any other number is registered, the bet loses. This is a one shake bet and pays out odds such as 15 for 1.

A bet may be placed in the hardway area 54. A bet made in the hardway area 54 denotes a request for a specific "Hardway" number. Referring to FIG. 1, prior to the shake, the player tells the dealer which hardway representation 77 to move the bet to and the dealer moves the bet. The bet is placed on a specific location along the border 77*a* (for example, in FIG. 1 at several border seat number locations for one of the hardway representations 77) of the representation 77 to identify from which bet box 20, i.e. seat number, the bet was moved. If a "seven" or combination of unequal faces equaling the chosen hardway number is registered by the first set of dice 82 before the dice register the same faces equalling the hardway number, all hardway bets lose. Hardway odds are typically posted on the table and may be 8 for 1 on the four and ten and 10 for 1 on the six and eight.

Referring FIGS. 2, 3 and FIG. 8, the players may also wager on a "real hardways" or progressive jackpot portion of the shake dice game of the present invention. A potential progressive jackpot or real hardway occurs when the top face of the first set of dice 82 and the top face of the third die 86 all register the same number. In addition, the player occupying the seat 38 and playing from the corresponding bet box 20 having numbers 39*a* and 74*a* respectively equal to the number registered by the first set of dice 82 and third die 86 must have made a wager on the progressive jackpot portion of the game. In the preferred embodiment, the progressive jackpot occurs when all the top faces of the first set of dice 82 and third die 86 all display the same number of pips and the player occupying the seat 38 (FIG. 1) having the number 39*a* equal to the pips on each of the dice has made a bet on the progressive jackpot. If the progressive jackpot does not occur all progressive jackpot bets lose; however, the amount of the progressive jackpot winnings will typically increase due to the wagering. A bet on the progressive jackpot is a one shake bet.

To wager on a progressive jackpot occurrence on the next shake, a player places a chip 17 or coin (not shown) in the slot 79 by the progressive jackpot area 78 corresponding to the player's bet box 20. The tabulating system 158 verifies the bet and tabulates and displays the amount of the progressive jackpot. The tabulating system 158 is similar to the jackpot tabulating system described in U.S. Pat. No. 5,078,405, incorporated herein by reference. Disposed in the table 34, beneath the slot is a distinguishing device 160 for determining whether the chip or coin placed in the slot 79 is a valid chip. The device 160 may be a Coin Comparitor Model CC-40 manufactured by Coin Mechanisms, Inc. of Glendale Heights, Ill.; however, other distinguishing devices which determine whether a chip or coin is valid are also equally suitable.

All of the distinguishing devices 160 are operatively connected to and output a signal to a central processing unit 162. The central processing unit 162 tracks the amount of the bets placed on the progressive jackpot portion of the shake dice game and determines an amount which is to be paid to a player or players who have wagered on the progressive jackpot immediately prior to a shake of a dice on which a progressive jackpot occurs. This amount is typically some portion of the total amount wagered on the progressive jackpot after the last occurrence of a progressive jackpot. The amount of the winnings for a winning wager on a progressive jackpot is preferably displayed on a display device 164 to entice the players to wager on the progressive jackpot. The central processing unit 162 outputs a signal to the display device 164 to cause the display device to display the desired amount.

When all three dice 80 register the same number, the dealer checks the display device 164 to determine whether the player occupying the seat 38 of that number has made a wager on the progressive jackpot by placing a token or coin in the slot 79. If a wager has been made, the player wins the determined amount of the progressive jackpot. The progressive jackpot amount may then be set to zero or base amount greater than zero.

Figure 9:
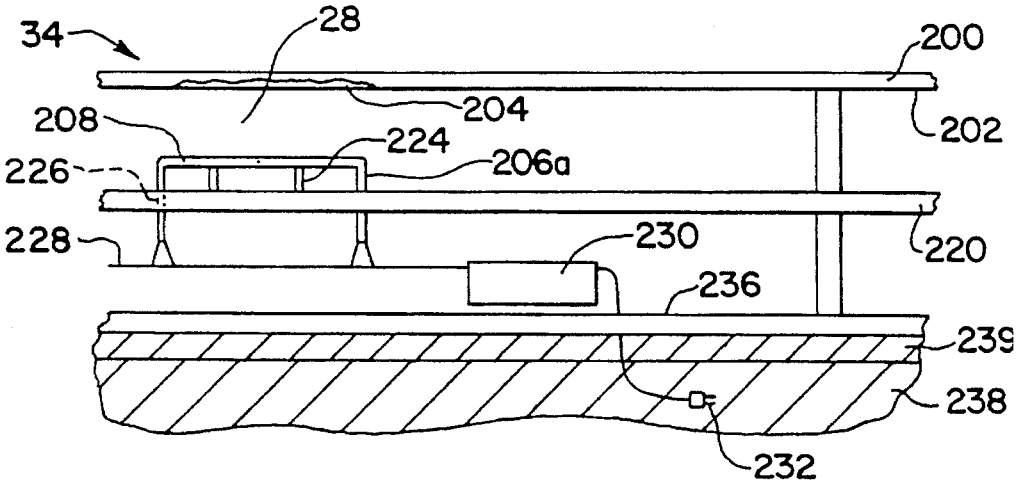
FIG. 9 is a partial sectional view taken generally along the line 9—9 in FIG. 1.
Figure 10:
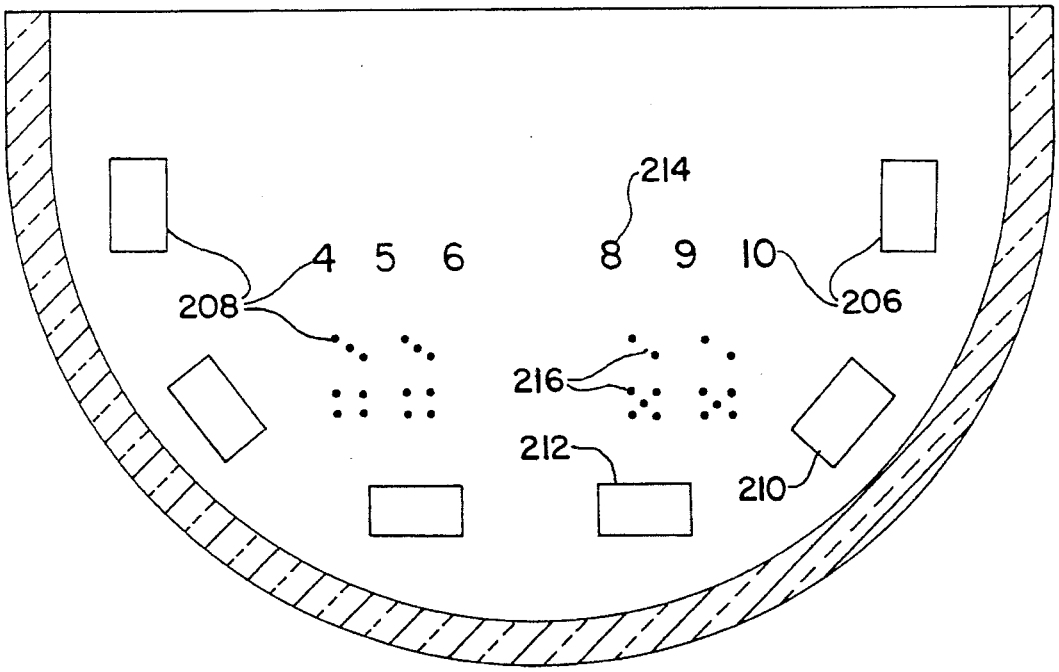
FIG. 10 is a plan view of a middle leaf forming a part of the table of FIG. 1.

Referring to FIGS. 1, 9 and 10, a preferred embodiment of the table 34 as shown. The table 34 is particularly suited to attract people to wager on the shake dice game and also to allow players at the table to communicate to parties outside the immediate gaming area without having to leave the table.

The table 34 includes a means for illuminating and highlighting the various playing representatives on the playing surface 10. The table 34 has an upper transparent leaf 200, preferably made of plexiglass although other transparent materials such as tempered glass or the like are also contemplated. On the upper leaf 200, configurations 204 which upon illumination delineate the playing areas on the playing surface 10 are placed. Preferably the configurations 204 are reversed etched on the lower surface 202 of the leaf 200. For example, in the shake dice game, the representation areas 28 and betting boxes 20 are reversed etched in the appropriate locations on the lower surface 202 so that the representations correctly appear when viewed from above the leaf 200. The configurations 204 can also be formed by other means such as silkscreening or the like.

Below the leaf 200 are light sources 206, which are preferably located directly below the reversed etched areas 204. The light from the light sources 206 is reflected and scattered by the reversed etchings 204 so that the configurations 204 are delineated and visually highlighted. Preferably the light sources 206 are formed by neon lamps 208. To increase the visual highlighting of the particular reversed etched area 204, the lamps 208 are uniquely configured to accent the particular reversed etched area 204 which is being highlighted. For example, neon lamps or tubes 210 for the bet boxes 20 are configured in the form of a rectangle which accents the outer border 212 of the central area 46. The lamps 214 beneath the representation areas 28 are formed in the shape of a numeral which corresponds to the numeral for that particular representation area. For the hardways areas 77, neon lamps 216 may be fashioned as points to correspond to the pips 218 on the dice representations 77.

The neon lamps 206 are attached to a middle leaf 220. The middle leaf 220, preferably dark, is constructed of an opaque plastic to highlight the neon lamps 206. To allow for replacement of the lamps 206, the lamps are removably held by clamps 224 and the ends of the neon lamps **206*a* extend downward through apertures 226 formed in the leaf 220. The lower ends 206*a* of the lamps 206 are electrically connected to electrical connectors 228 which provide power from a transformer 230 which is appropriately sized to illuminate the neon lamps 206. The transformer 230 is preferably removably plugged to a source of electric power by plug 232 or may be hardwired into an electrical power system. The transformer 230 is located below the middle leaf 220 and attached to a third or lower leaf 236**.

The table 34 is particularly configured to allow the playing surface 10 to be changed so that different casino games may be played on the surface. In particular, the upper leaf 200, middle leaf 220 and lower leaf 236 may be attached to each other to form a removable top 237. The top 237 is preferably held by a boss 239 formed on the interior surface of an exterior 238 of the table so that the top 237 may be slidingly removed by pulling the top in a direction generally normal to and outward from the inner edge 15. Table 34 may then be altered for the playing of a different game by the sliding insert of a playing surface (not shown) configured for the other game, such as a blackjack configuration. In addition, the utilization of the illuminated playing areas can be adapted to these other playing surfaces.

Figure 11:
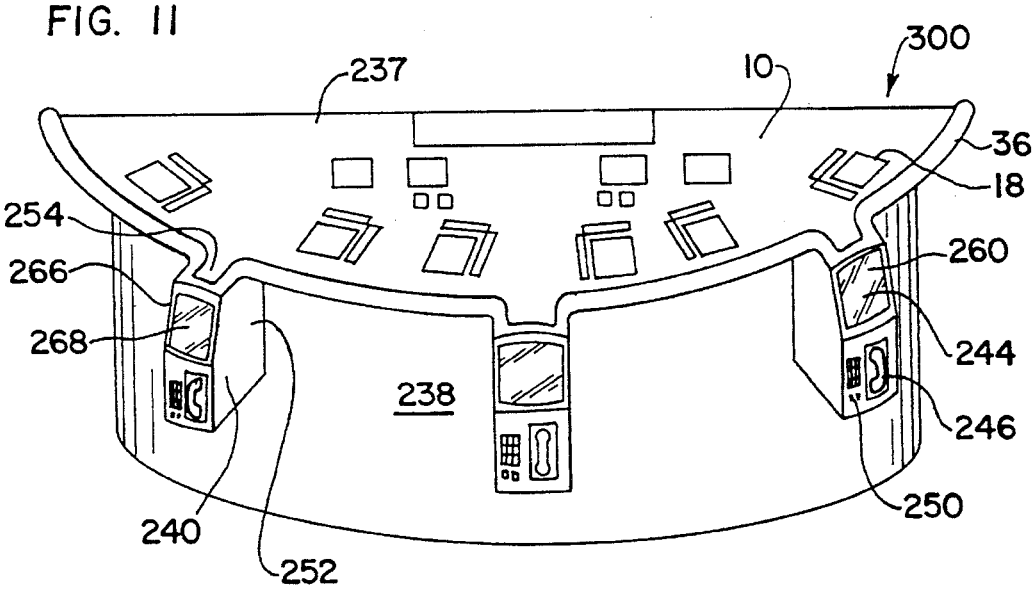
FIG. 11 is a front perspective view of an alternate embodiment table for playing the dice game of the present invention.

Referring to FIG. 11, in an alternate embodiment of the table 34 indicated at 300, the chairs 38 (not shown in FIG. 11) are in close proximity to the exterior 238 of the table 34, corresponding to the wagering areas 18 from right to left in FIG. 11, so that the players are properly positioned about the table and may reach the game board 10. Without leaving the table 300, the players may make or receive telephone calls, messages or news such as sporting news, by utilizing communication centers 240 attached to and spaced about the outer peripheral edge 36 of the table 300. To minimize the number of communication centers 240 and yet allow each player to have access to a center, the centers are shared by adjacent players. Preferably centers 240 are located between the adjacent player one and player two positions, the player three and player four positions, and player five and player six positions.

Each of the communications centers 240 include a monitor 244 and telephone 246. The telephone 246 may also include a key pad 250 for dialing. The monitor 244 and telephone 246 are contained within a generally rectangular housing 252. The housing 252 has an upper surface 254 which is flush with the playing surface 10. Preferably the monitor 244 is located above the telephone 246 and the screen 260 of the monitor 244 is oriented to point generally outward an angled slightly upward for viewing. The monitors 244 may be of many types such as CRT, LCD or the like.

To facilitate the player's ability to communicate with the communication center 240, the center also includes an input device 266 such as a touch screen 268 covering the monitor 244. The touch screen 268 may be a CRYSTAL CLEAR touch screen manufactured by Interaction Systems, Inc., of Woburn, Mass. 01801 or similar device. For aesthetics the outer surface of the exterior 238 of the table 34 may be covered with formica or the like.

In operation, the player may communicate by touching the touch screen 268, for example by touching icons shown by the monitor 244. For example, the player may make dinner reservations by touching various icons on the screen. Also, as the player is playing the shake dice game, the monitor 244 may display news or sports scores. The player may also use the telephone 246 to make and receive telephone calls without having to leave the general vicinity of the table 300.

A specific embodiment of the novel casino dice game apparatus and method for playing according to the present invention has been described for the purposes of illustrating the manner in which the invention may be made and used. It should be understood that implementation of other variations, and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A dice game apparatus comprising:

a game board having a generally semicircular peripheral edge about which a plurality of players are located, the game board having designated thereon a series of crap bet placing boxes corresponding to each of the players and positioned in a repetitive pattern along a peripheral portion of the game board, the crap bet placing boxes designating the only place on which the players may place a bet;

a set of at least two dice having six faces with numerical representations thereon and a shake container with the dice being enclosed in the shake container, the shake container is configured and adapted so that each of the die randomly registers one of the faces after a shaking of the container; and a third die formed with six faces, each of the faces having a representation corresponding to a number on one of the faces of each of the die in the set of dice wherein the shake container forms at least two compartments with the set of dice being enclosed in a first compartment, and the third die being enclosed in the second compartment.

2. The game apparatus of claim 1 further including a set of two crap dice and wherein the game board includes designations of a plurality of possible outcomes from a random tumbling of the dice and registration of one of the faces of each of the dice, the betting boxes including a separated central area forming a plurality of bet areas, the areas only signifying bets which are transferred by a dealer to at least one of the designation areas of possible outcomes before a shake of the dice.

3. A dice game apparatus comprising:

a game board having a generally semicircular peripheral edge about which a plurality of players are located, the game board having designated thereon a series of crap bet placing boxes corresponding to each of the players and positioned in a repetitive pattern along a peripheral portion of the game board, the crap bet placing boxes designating the only place on which the players may place a bet;

a set of at least two dice having six faces with numerical representations thereon and a shake container with the dice being enclosed in the shake container, the shake container is configured and adapted so that each of the die randomly registers one of the faces after a shaking of the container;

a third die formed with six faces, each of the faces having a representation corresponding to a number on one of the faces of each of the die in the set of dice wherein the shake container forms at least two compartments with the set of dice being enclosed in a first compartment, and the third die being enclosed in the second compartment; and a progressive jackpot betting area corresponding to each of the betting boxes for wagering on a registration of the dice whereby all the first set of dice and the third die register faces having an equal numerical value.

4. The game apparatus of claim 3 further including a set of two crap dice and wherein the game board includes designations of a plurality of possible outcomes from a random tumbling of the dice and registration of one of the faces of each of the dice, the betting boxes including a separated central area forming a plurality of bet areas, the areas only signifying bets which are transferred by a dealer to at least one of the designation areas of possible outcomes before a shake of the dice.

* * * * *